United States Patent [19]

Warchol

[11] 4,404,044

[45] Sep. 13, 1983

[54] METHOD OF QUENCHING

[75] Inventor: Joseph F. Warchol, West Norriton, Pa.

[73] Assignee: E. F. Houghton & Co., Valley Forge, Pa.

[21] Appl. No.: 299,961

[22] Filed: Sep. 8, 1981

[51] Int. Cl.[3] ..... B23K 35/24

[52] U.S. Cl. ..... 148/18; 148/20.6; 148/28; 148/29; 526/208; 526/271; 526/272

[58] Field of Search ..... 148/18, 20.6, 28, 29; 526/208, 272, 496, 271, 524, 549

[56] References Cited

U.S. PATENT DOCUMENTS

| | | | |
|---|---|---|---|
| 3,475,232 | 10/1969 | Lewis et al. | 148/18 |
| 3,489,619 | 1/1970 | Brewster | 148/18 |
| 3,553,177 | 1/1971 | Hazen et al. | 260/78.5 |
| 3,560,455 | 2/1971 | Hazen et al. | 260/78.5 |
| 3,560,456 | 2/1971 | Hazen et al. | 260/78.5 |
| 3,560,457 | 2/1971 | Hazen et al. | 260/78.5 |
| 3,865,642 | 2/1975 | Foreman | 148/28 |
| 3,939,160 | 2/1976 | Tokuue et al. | 148/28 |
| 3,996,071 | 12/1976 | Tokuue et al. | 148/18 |
| 4,087,290 | 5/1978 | Kopietz et al. | 148/18 |
| 4,090,891 | 5/1978 | Mitamura et al. | 148/28 |

FOREIGN PATENT DOCUMENTS 53-10140 1/1978 Japan .

*Primary Examiner*—Veronica O'Keefe
*Attorney, Agent, or Firm*—Howson and Howson

[57] ABSTRACT

Aqueous quenching baths containing as an essential constituent a water-soluble salt of a copolymer of maleic, citraconic, or itaconic anhydride and a long chain alpha olefin are useful in quenching metal at cooling rates which are slower than that of water, and may be as slow as or slower than those obtained using a hydrocarbon oil as the quenching medium.

6 Claims, 3 Drawing Figures

FIG. I.
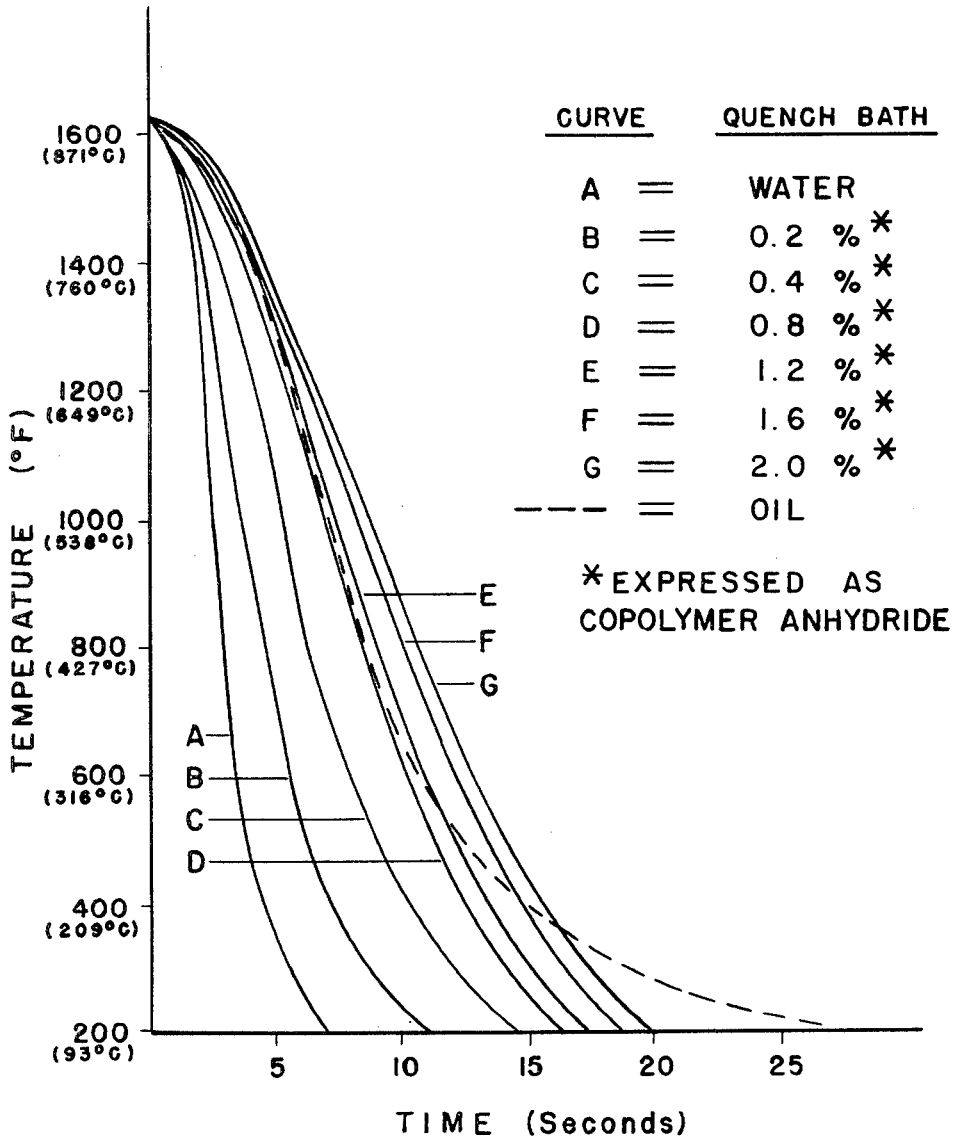

FIG. II.
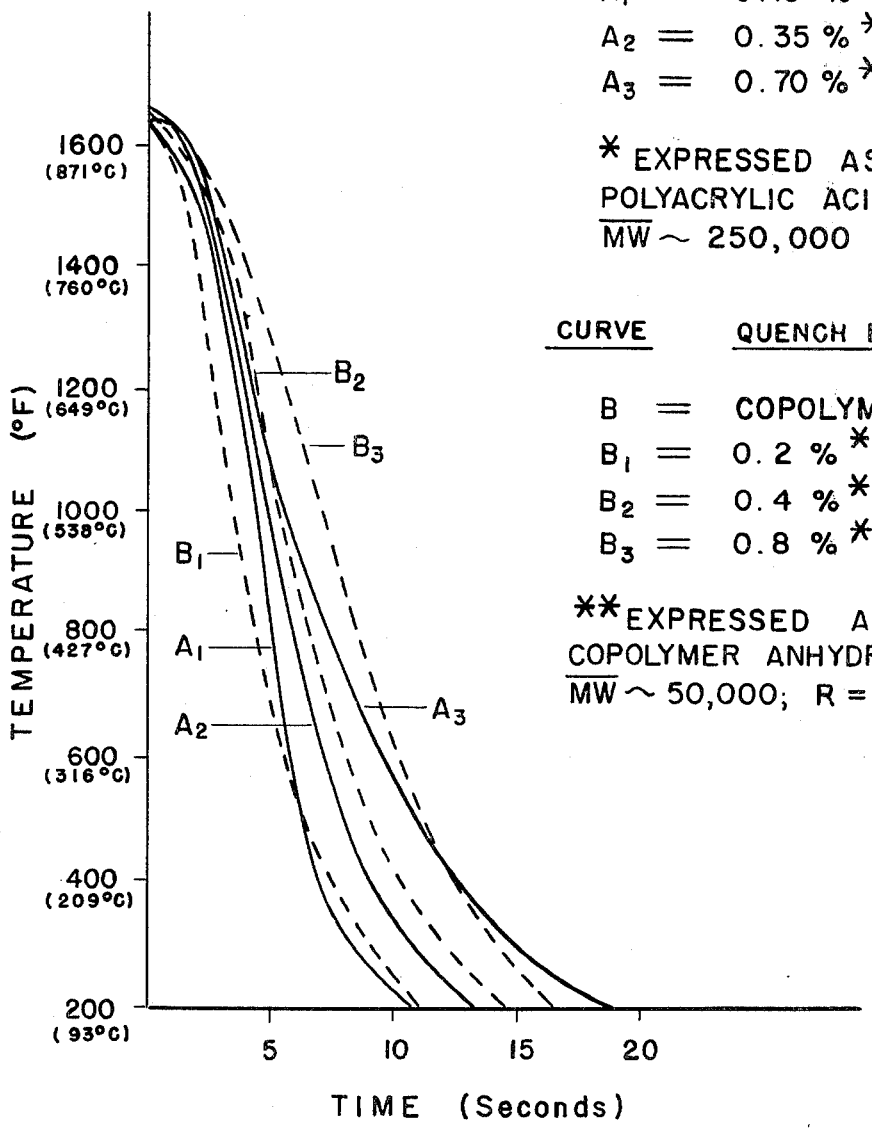
| CURVE | | QUENCH BATH |
|---|---|---|
| A | = | POLYACRYLATE |
| $A_1$ | = | 0.18 % * |
| $A_2$ | = | 0.35 % * |
| $A_3$ | = | 0.70 % * |
* EXPRESSED AS POLYACRYLIC ACID; $\overline{MW} \sim 250,000$
| CURVE | | QUENCH BATH |
|---|---|---|
| B | = | COPOLYMER |
| $B_1$ | = | 0.2 % ** |
| $B_2$ | = | 0.4 % ** |
| $B_3$ | = | 0.8 % ** |
** EXPRESSED AS COPOLYMER ANHYDRIDE; $\overline{MW} \sim 50,000$; $R = C_{16}$ FIG. III.
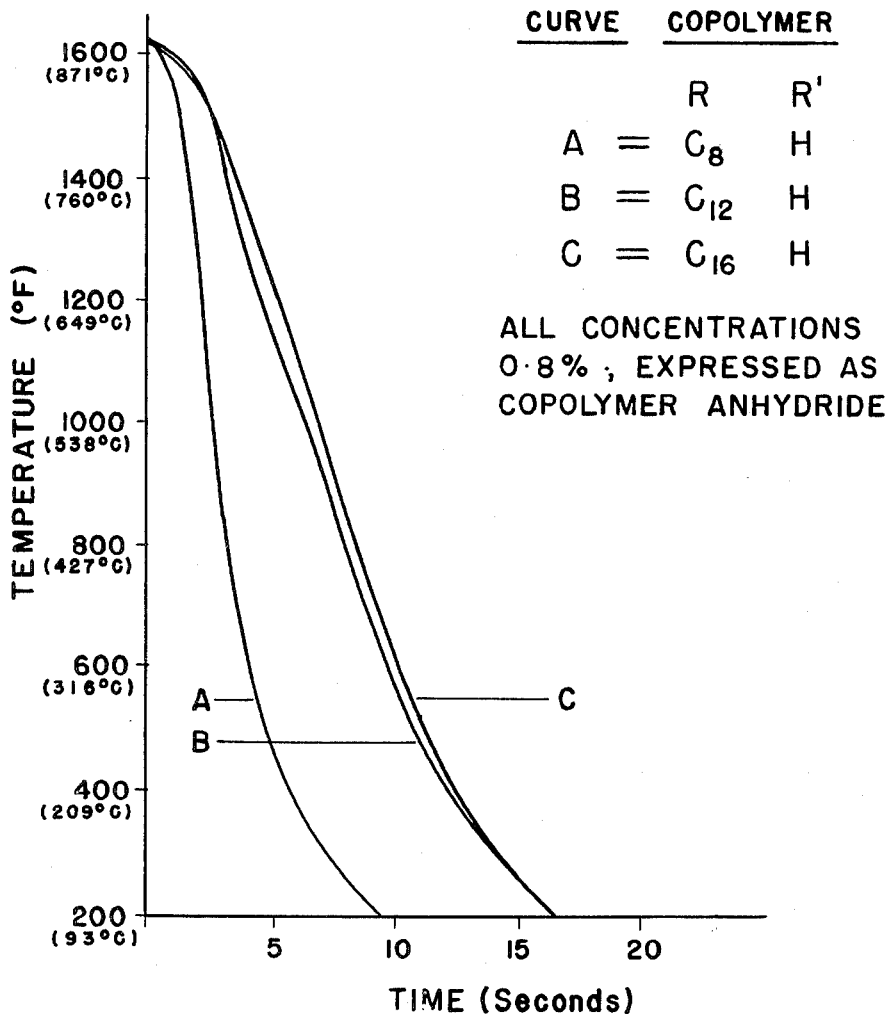

METHOD OF QUENCHING

BACKGROUND OF THE INVENTION

This invention relates to a novel method for quenching metal employing as the quenching medium aqueous solutions of water-soluble salts of certain copolymers of unsaturated dibasic acids and long chain alpha olefins.

The physical properties of metals, such as steel, can be modified by heat treatment, which generally involves heating the metal to elevated temperatures, followed by quenching in air, a molten salt bath, water, an aqueous solution of a water-soluble salt or a polyol, or oil. In such heat treatment, the rate of cooling is most important in obtaining the particular physical properties which are sought.

Water, for example, causes very rapid cooling of the metal, and with some metals, such as steel, may produce excessive strains which warp and crack the steel. On the other hand, hydrocarbon oils provide a relatively slow rate of cooling. Such slow cooling may provide a steel with desired ductility at the expense of hardness.

Aqueous solutions of various water-soluble polymers have been suggested for use as quenching fluids to provide cooling rates intermediate to and including those provided by water and hydrocarbon oils. The decrease in cooling rate provided by such solutions is believed to be due to various phenomena. For example, certain water-soluble high molecular weight polyalkylene glycols are believed to cause a reduction in cooling rate by coming out of solution at elevated temperatures and forming a higher-boiling insulating layer on the metal being quenched. Unfortunately, such glycols, like oil, have the disadvantage of producing stained or darkened metal parts due to drag-out on the hot parts.

Aqueous solutions of certain water-soluble salts of polyacrylic acid have also been suggested for use as quenching baths for steel and other metals. Such salts are believed to cause the formation of a relatively stable vapor envelope about the metal being quenched, which envelope substantially reduces the cooling rate. By use of such quenching baths, it is possible to obtain non-martensitic structures in steel without subsequent heat treatments.

A disadvantage of polyacrylate quenching baths is that, although the cooling rate can be decreased by increasing the concentration of the polyacrylate, such increase in concentration also causes an increase in bath viscosity. At high bath viscosities, some of the polyacrylate may be removed from the bath as a coating on the quenched metal. Such "drag-out" results in unstable quenching conditions, since bath concentration decreases with use. Thus, the bath must be monitored continually in order to maintain the desired quenching conditions, particularly bath concentration.

It is a primary object of the present invention to provide an aqueous medium for quenching metal whose composition can be varied to provide a broad range of quenching rates between the quenching rates of water and oil, as well as rates similar to those of oil.

Another object of this invention is to provide a novel method for quenching heated metal to obtain quenched metal parts having the desired physical properties and improved appearance.

A further object of this invention is to provide a new and useful process for cooling austenitized ferrous metal parts to produce therein non-martensitic or martensitic microstructures as desired.

Yet another object of this invention is to provide a novel quenching method using an aqueous bath comprising a solution of a water-soluble salt of certain copolymers, the viscosity of which solution does not vary significantly with copolymer concentration, whereby maintaining of desired quenching conditions is simplified.

These and other objects of this invention will become further apparent from a consideration of this specification, appended claims, and drawings in which:

FIG. I illustrates a series of continuous cooling curves for a steel cylinder quenched in water (curve A), in aqueous solutions of various concentrations of a water-soluble salt of a copolymer according to this invention (curved B to G), and in a typical hydrocarbon oil used in quenching metal (dotted line);

FIG. II illustrates a series of pairs of continuous cooling curves for a steel cylinder quenched in either an aqueous solution of sodium polyacrylate (designated "A" with subscript) or an aqueous solution of a water-soluble salt of a copolymer according to this invention (designated "B" with subscript), each pair of curves representing aqueous solutions of similar concentration; and FIG. III illustrates a series of continuous cooling curves for a steel cylinder quenched in aqueous solutions of different copolymers according to this invention.

While this invention is applicable to heat treatment of various metals and their alloys, the use thereof is explained hereinafter with particular reference to carbon-containing ferrous metals, e.g. steel.

Generically, the objects of this inventin are obtained by contacting a metal, such as steel, which has been heated to elevated temperatures, with an aqueous quenching medium containing as an essential constituent, from about 0.2 to about 10.%, by weight, expressed as the anhydride, of a water-soluble salt of a copolymer containing recurring units of the general formula:

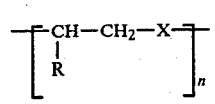

(I)

in which X is selected from the group consisting of:

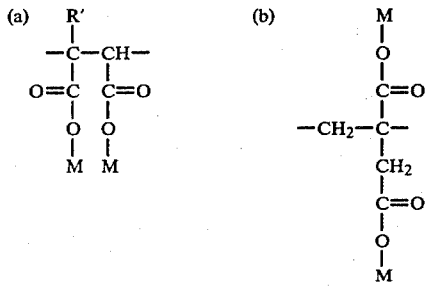

in which R is a straight or branched chain alkyl group in which the backbone of the chain contains from about 8 to about 28 carbon atoms, preferably from about 12 to about 20 carbon atoms, R′ is hydrogen or methyl, M is a cation selected from the group consisting of an alkali metal cation, an ammonium ion, a lower alkyl amine ion, and a water-soluble alkanolamine ion, and n is an integer which provides said copolymer with a molecular weight of from about 25,000 to about 250,000.

Preferred copolymers are the potassium salts of copolyers of maleic anhydride and 1-octadecene or 1-tetradecene, in which the monomers are present in the copolymers in substantially stoichiometric proportions, and the copolymers have a molecular weight of from about 40,000 to about 60,000.

It was discovered that the quenching medium used in the method of this invention can be varied in concentration of the essential copolymer salt constituent to provide cooling rates between the cooling rates of water and oil, as well as cooling rates which are slower than oil. It was particularly surprising to discover that when the concentration of the copolymer salt in the bath was increased from relatively low concentrations to substantially higher concentrations, although the cooling rate decreased with increasing concentration, the viscosity of the quenching bath did not change significantly. This discovery was particularly important, for by means of the present invention, quenching conditions vary little in use, even when the copolymer salt is present at relatively high concentrations. Thus, the method of the present invention does not suffer from an undesirable characteristic inherent in the use of certain other aqueous base quenching baths, i.e. loss of the quenchant material resulting in difficulty in maintaining uniform quenching conditions, particularly uniform viscosity.

The copolymer salts used in the method of this invention are obtained by copolymerizing substantially stoichiometric amounts of certain unsaturated acid anhydrides and certain long chain compounds having terminal ethylenic unsaturation, i.e. $>C{=}CH_2$. Typical of the anhydrides are those of maleic, itaconic, and citraconic acid, maleic anhydride being a preferred monomer for use in the copolymerization reaction. When the anhydride is either that of maleic or citraconic acid, constituent X in formula I has the (a) construction, whereas it is believed that where itaconic anhydride is employed as the anhydride monomer, the X constituent has the (b) construction.

Examples of compounds having terminal ethylenic unsaturation are relatively long chain alpha olefins containing from 10 to 30 carbon atoms. Preferred alpha olefins are those containing from 14 to 22 carbon atoms.

Suitable alpha olefins include 1-dodecene, 1-tetradecene, 1-docosene, 1-hexacosene, 1-pentacosene, 1-triacontene, and polyisobutylenes. A particularly preferred alpha olefin monomer is 1-octadecene.

The copolymers useful in the quenching method of this invention may be prepared by the processes described in U.S. Pat. Nos. 3,553,177; 3,560,455; 3,560,456; and 3,560,457; the disclosures of which patents are incorporated herein by reference.

Particularly preferred copolymers are those obtained by copolymerizing substantially stoichiometric equivalents of either 1-octadecene or 1-tetradecene and maleic anhydride, followed by hydrolysis with potassium hydroxide to obtain the potassium salt of the copolymers. Such copolymers preferably have a molecular weight in the range of about 40,000 to about 60,000.

The method of the invention makes possible a wide variety of quenching conditions. Those factors which affect quenching rate are the concentration and molecular weight of the copolymer, the temperature of the quenching bath, and the presence or absence and rate of agitation of the bath.

While even very small amounts of the copolymer salt dissolved in water will reduce the quenching rate as compared to water alone, for most practical applications, a minimum of about 0.2% by weight of the copolymer salt, expressed as the anhydride, will ordinarily be used. A practical upper limit on concentration is about 5%, although it is possible to use even higher concentrations, since, as noted above, substantial increases in both concentration cause only very small increases in the viscosity of the quenching bath. Preferably, the copolymer salt is present in the quenching bath in an amount of from about 0.5 to about 5%, by weight, expressed as the anhydride.

While agitation of the quenching bath is unnecessary, and tends to increase the cooling rate of a bath of given concentration, in many cases moderate agitation may be desirable to increase the uniformity of the cooling action of the quenchant. Advantageously, such agitation does not result in a breakdown of the copolymer salt.

The quenching rate generally decreases with increasing quenchant temperature measured prior to contact by the immersed metal, the preferred range of quenching temperatures being from about 27° C. (80° F.) to about 60° C. (140° F.) for most practical uses, although somewhat lower or higher quenching temperatures may be used.

In addition to the essential copolymer salt, the aqueous quenching bath may contain additives to improve performance in certain applications. For example, there can be added to the bath corrosion inhibitors such as sodium nitrite, alkanol amines, or other additives which prevent corrosion of quench tanks, conveyor belts, and quenchant parts, as well as additives including defoamers, biocides, metal deactivators, etc.

The aqueous quenching bath of this invention is based on the use of a copolymer salt which is relatively inexpensive, non-explosive, substantially non-poisonous, and of very low toxicity to humans. In addition, the copolymers are biodegradable, and thus substantially non-polluting of the environment.

TEST PROCEDURES FOR OBTAINING COOLING CURVES

The test specimen was a cylinder 60 millimeters long and 10 millimeters in diameter, and composed of non-scaling austenitic steel AISI 302 B. A miniature Chromel-Alumel thermocouple was inserted into the center of the cylinder, and the temperature-representing output of the thermocouple was recorded by means of a strip chart recorder (Speedomax H, Model S, from Leeds & Northrup, North Wales, PA; or Chessell Model 321, Chessell Corporation, Newtown, PA). The test specimen was heated in an electric furnace with a hole in the door through which the test specimen was introduced. The furnace was operated without a controlled atmosphere and adjusted to 927° C. (1700° F.). In each test, the temperature of the test specimen at the time of immersion was 882° C. (1620° F.). The quantity of quenchant used was 450 grams, and means were provided for heating the quenchant to various temperatures, which were measured by a thermometer immersed in the quenchant. Slightly turbulent agitation of about 10 centimeters per second was provided by a laboratory stirrer, whereby the quenchant was circulated with respect to the test specimen.

Each cooling curve in FIGS. I, II, and III shows the decrease in the temperature of the test specimen with time after immersion in the quenching bath used in the particular test. The ordinates of these figures represent temperature of the test specimens in F°, as measured by the thermocouple, and the abscissae represent time in seconds measured from the instant of immersion of each specimen in the quenchant bath. The temperature and time scales are the same for all figures.

The cooling curves of FIG. I were obtained with aqueous solutions of copolymers of maleic anhydride (subsequently hydrolized with potassium hydroxide) and 1-octadecene (M.W.≃50,000) at concentrations ranging from 0.2% by weight, as the anhydride (curve B), to 2.0% (curve G). The control baths were water (curve A) and mineral oil (dotted line).

The curves B, C, D, E, F, and G of FIG. I, obtained using quenching baths according to this invention, show that as the concentration of maleic anhydride/1-octadecene copolymer is increased, the cooling rate is reduced. At the higher concentrations, the cooling rates substantially simulate that of mineral oil. Thus, quenching baths according to the present invention can provide the benefits of slow cooling comparable to that provided by mineral oil, without the disadvantages of the latter quenching medium, such as discoloration of the quenched part and the hazard of fire, which is inherent in the use of an oil quenching bath. Also, tanks containing the quenching medium of this invention can be cleaned with much less difficulty than tanks which formerly contained quenching oil.

Referring to FIG. II, the cooling curves there illustrated were obtained with aqueous solutions of either a maleic anhydride/1-octadecene copolymer (hydrolized with potassium hydroxide, M.W.≃50,000) according to the present invention, or with an aqueous solution of sodium polyacrylate (M.W.≃250,000). Curves $A_1$, $A_2$, and $A_3$ represent solutions of the polyacrylate at concentrations of 0.18%, 0.35%, and 0.70% (as polyacrylic acid), respectively, whereas curves $B_1$, $B_2$, and $B_3$ represent maleic anhydride/1-octadecene copolymer solutions of the present invention at similar concentrations (0.2%, 0.4%, and 0.8%, respectively). A comparison of the respective quenching baths of similar concentration, i.e. $A_1$ vs. $B_1$, etc., show that, for a similar concentration, the copolymers of this invention provide cooling rates similar to those provided by commercial polyacrylates.

Of particular importance is the fact that the viscosity of quenching baths of the present invention containing copolymers does not increase appreciably with increases in concentration. On the other hand, as the concentration of sodium polyacrylate is increased in the quenching bath, there is a corresponding increase in the viscosity of the bath. These differences between the respective bath types can be seen by reference to Table I, below:

TABLE I

| Concentration (weight percent)* | Viscosity (cSt at 37.8° C. (100° F.) | |
|---|---|---|
| | Maleic anhydride/ 1-octadecene copolymer+ | Sodium polyacrylate |
| 0.18 | 0.687 | ≃2.7 |
| 0.35 | 0.696 | ≃5 |
| 0.70 | 0.729 | ≃10 |
| 1.40 | 0.800 | ≃20 |

*Expressed either as copolymer anhydride or polyacrylic acid, respectively
+KOH hydrolized The low viscosities of quenching baths of this invention even at concentrations as high as 1.4% show that there is less chance of polymer degradation when the baths are subject to shearing forces. This phenomenon is extremely important, enabling great control of quench bath characteristics, especially viscosity, where the bath is subjected to agitation in use. The fact that the viscosities of the quenching baths of this invention do not increase significantly with increases in concentration (0.687 cSt for a 0.18% solution by weight vs. 0.800 for a 1.4% solution) is also of considerable importance in minimizing loss of copolymer from the bath as a coating on the quenched metal parts. By way of contrast, with baths in which bath viscosity increases with bath concentration (see sodium polyacrylate, Table I, above), considerable drag-out of polymer on quenched parts can take place at higher bath concentrations, resulting in loss of quenchant, which causes undesirable changes in quenching conditions, e.g. bath concentration, with erratic quenching results.

In Table II, below, are set forth cooling times (sec.) for various quenching baths, the comparison being between those baths containing the copolymers of this invention and those containing "monomers" from which they are formed, as well as for water and oil baths.

TABLE II

| Bath | Composition* | Cooling Time (sec.) 760 to 204° C. (1400 to 400° F.)** |
|---|---|---|
| A | water | ≃3-5 |
| B | n-octadecenyl succinic anhydride (K) | 6.6 |
| C | oleic acid (Na) | 6.2 |
| D | n-hexadecyl succinic anhydride (Na) | 6.0 |
| E | n-octadecyl succinic anhydride (Na) | 6.4 |
| F | n-octadecyl succinic anhydride (K) | 5.8 |
| G | copolymer+ | 10.8 |
| H | copolymer++ | 9.4 |
| I | mineral oil | ≃10-11 |

*0.8% by weight, expressed as anhydride, or acid in the case of C.
**Bath temperature 26.7° C. (80° F.)
+Potassium salt of copolymer of maleic anhydride and 1-octadecene.
++Sodium salt of copolymer of maleic anhydride and 1-octadecene.

From the cooling data given in Table II, above, it can be seen that the baths containing the "monomers" (Baths B to F, inclusive) have markedly different characteristics, providing substantially faster cooling times than those provided by the quenching baths of this invention (Baths G and H). In fact, there is a good four (4) seconds difference in cooling time between the monomers and copolymers when present in the same bath concentration. This indicates some uniqueness in the polymers beyond more chemical functionality.

The cooling curves in FIG. III show that as the side chain R in copolymer formula (I) increases in length, the cooling rate tends to decrease.

TEST PROCEDURES FOR STEEL SAMPLES

The tests below described were conducted to show the metallurgical changes in ferrous metal when heat-treated according to the method of this invention.

In these tests, a carbon steel, namely SAE 1045, and an alloy steel, namely SAE 4340, were used. The test specimens were 1" (2.54 cm.) in length and were cut from 1" (2.54 cm.) diameter bar stock. Two samples of each type of steel were used in the tests.

Four different quenching baths were used. Two of the baths were controls, one comprising water, and the other a mineral oil. The third bath contained a 0.7% solution, by weight (expressed as acid), of a sodium polyacrylate (viscosity 20 cSt at 37.8° C. (100° F.)). The fourth bath contained 0.8%, by weight (as anhydride), of the potassium salt of a maleic anhydride/1-octadecene copolymer having a molecular weight of about 50,000. The baths containing the polyacrylate and copolymer were at a temperature of 37.8° C. (100° F.), whereas the water bath was at 27° C. (80° F.) and the oil bath at 60° C. (140° F.).

Each test specimen was quenched individually in about 3,250 grams of quenchant in a one-gallon bucket. The quenchant was agitated by means of a propeller mixer (Fisher Dyna-Mix, setting 4), and a vertical baffle was located in the bath to cause upward flow of quenchant in the area of the test specimen.

Prior to quenching, all test specimens were heated to the austenitizing temperature for the particular steel, i.e. 843.3° C. (1550° F.), using an electrically heated (resistance) furnace. The austenitizing time in each instance was about 40-50 minutes for each specimen.

Each test specimen was quenched until it had cooled to about the temperature of the quenching bath.

Following quenching, both ends of each specimen were ground to obtain a smooth, clear surface, and the Rockwell C hardness of the specimens was determined by making six (6) indentations, three (3) at each end of the specimen: one in the center, and one toward each circumferential edge at an angle of 180° with respect to each other. The results of the above described tests are set forth in Table III, below:

TABLE III

| QUENCHANT | CONCENTRATION (weight %) | TEMPERATURE (°F.) | ROCKWELL HARDNESS* STEEL TYPE SAE 1045 Top of Specimen | STEEL TYPE SAE 1045 Bottom of Specimen | STEEL TYPE SAE 4340 Top of Specimen | STEEL TYPE SAE 4340 Bottom of Specimen |
|---|---|---|---|---|---|---|
| Water | 100 | 80 | 53.0-58.5 (55.8) | 53.5-59.5 (56.5) | 50.6-60.4 (55.5) | 52.0-60.0 (56.0) |
| Polyacrylate | 0.7 | 100 | 15.0-21.5 (18.3) | 11.5-22.0 (16.8) | 50.3-55.8 (53.1) | 51.3-55.8 (53.6) |
| Copolymer | 0.8 | 100 | 25.0-31.5 (28.3) | 18.0-33.7 (25.9) | 52.8-56.3 (54.6) | 52.5-55.8 (54.2) |
| Mineral Oil | 100 | 140 | 25.5-35.6 (30.6) | 23.8-38.0 (30.9) | 52.0-55.2 (53.6) | 52.2-55.3 (53.8) |

*Numbers separated by a hyphen represent the range of values obtained; those in parentheses are average values.

What is claimed:

1. In a process of quenching which is useful in the heat treatment of metals wherein a metal is heated to an elevated temperature and then quenched in a bath comprising a liquid quenching medium to effect desirable metallurgical changes in the metal, the improvement which comprises using as said quenching medium an aqueous solution consisting essentially of from about 0.2% to about 10%, by weight, expressed as the anhydride, of a water-soluble salt of a copolymer containing recurring units of the general formula:

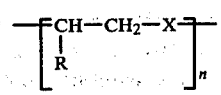

in which X is selected from the group consisting of:

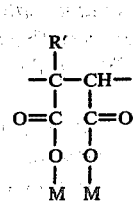

(a)

and

-continued

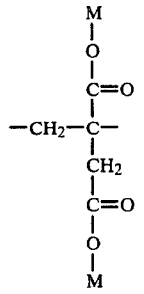

(b)

in which R is a straight or branched chain alkyl group in which the backbone of the chain contains from about 8 to about 28 carbon atoms, R′ is hydrogen or methyl, M is a cation selected from the group consisting of an alkali metal cation, an ammonium ion, a lower alkyl amine ion, and a water-soluble alkanolamine ion, and n is an integer which provides said copolymer with a molecular weight of from about 25,000 to about 250,000.

2. A process according to claim 1 in which in said copolymer, X comprises constituent (a), R is an alkyl group containing from 12 to 20 carbon atoms, M is an alkali metal cation, and said copolymer has a molecular weight of from about 40,000 to about 60,000.

3. A process according to claim 2 in which said quenching medium contains from about 0.5% to about 5% of said copolymer, R is a straight chain alkyl group containing about 18 carbon atoms, R′ is hydrogen, M is a potassium ion, and said copolymer has a molecular weight of about 50,000.

4. A process according to claim 2 in which said quenching medium contains from about 0. 5% to about 5% of said copolymer, R is a straight chain alkyl group containing about 18 carbon atoms, R′ is methyl, M is a potassium ion, and said copolymer has a molecular weight of about 50,000.

5. A process according to claim 1 in which in said copolymer, X comprises constituent (b), R is an alkyl group containing from about 12 to about 20 carbon atoms, M is an alkali metal cation, and said copolymer has a molecular weight of from about 40,000 to about 60,000.

6. A process according to claim 5 in which said quenching medium contains from about 0.5% to about 5% of said copolymer, and in which in said copolymer R is a straight chain alkyl group containing about 18 carbon atoms, M is a potassium ion, and said copolymer has a molecular weight of about 50,000.

* * * * *